United States Patent [19]

Tani formerly Nishikawa et al.

[11] 4,018,524

[45] Apr. 19, 1977

[54] CONSTRUCTION FOR USE WITH AN ELECTROPHOTOGRAPHIC COPYING MACHINE OF WET DEVELOPING TYPE

[75] Inventors: Tatsuo Tani formerly Nishikawa; Kenzo Ariyama, both of Tokyo, Japan

[73] Assignee: Ricoh Co., Ltd., Japan

[22] Filed: Dec. 10, 1975

[21] Appl. No.: 639,449

[30] Foreign Application Priority Data

Dec. 29, 1974 Japan ..... 50-338

[52] U.S. Cl. ..... 355/10; 118/DIG. 23; 96/1 LY; 427/15; 427/17

[51] Int. Cl.[2] ..... G03G 15/10

[58] Field of Search ..... 355/10; 118/DIG. 23; 96/1 LY; 427/15, 17

[56] References Cited

UNITED STATES PATENTS

| | | | |
|---|---|---|---|
| 3,759,220 | 9/1973 | Saito | 118/DIG. 23 |
| 3,951,542 | 4/1976 | Ito | 355/15 |
| R28,568 | 10/1975 | Saito | 118/DIG. 23 |

*Primary Examiner*—Monroe H. Hayes

*Attorney, Agent, or Firm*—McGlew and Tuttle

[57] ABSTRACT

A construction for preventing a scattering or spillage of a developing solution applied to the peripheral surface of a rotating photosensitive drum beyond the lateral ends thereof in an electrophotographic copying machine of wet developing type. Two end plates which rotate with the drum are each provided with an axially extending cylindrical hub portion on which a stationary flow guide ring is sealingly engaged. A lateral flow of solution on the peripheral drum surface is guided along the guide plate to flow down without scattering the flow and is collected in a reservoir below the drum.

14 Claims, 4 Drawing Figures

CONSTRUCTION FOR USE WITH AN ELECTROPHOTOGRAPHIC COPYING MACHINE OF WET DEVELOPING TYPE

BACKGROUND OF THE INVENTION

The invention relates to a construction for preventing a scattering of a developing solution or cleaning liquid applied to the photosensitive member of an electrophotographic copying machine beyond the side or end face thereof.

Generally, an electrostatic latent image is formed in an electrophotographic copying machine by uniformly charging the surface of a photosensitive member having a photoconductive layer thereon, and selectively removing the surface charge by an image-imparting exposure. The latent image is converted into a visual image by applying to the surface on which it is formed a toner particle which is charged to the opposite polarity from that of the latent image. The developed image is brought into a superimposed relationship with a transfer sheet, to the rear side of which is applied a potential of sufficient magnitude and proper polarity, thus transferring the toner particle which forms the image onto the transfer sheet. The transferred image is fixed as by heating. On the other hand, there remains a certain amount of toner particle on the surface of the photosensitive member subsequent to the transfer step, and such particle is removed by a cleaning step. In the electrophotographic process mentioned above, liquid may be used in the developing station where a wet developing process is employed and also in the cleaning station where a liquid cleaning process is employed. Where such liquid is used, it is necessary to prevent the liquid from flowing to unintended portions to contaminate the apparatus or mar the image.

One of the proposals which have been made to prevent such an unintended liquid flow is illustrated in FIG. 1. In this FIG., a photosensitive member 1 is provided with a pair of developer troughs 2 outside the area in which an image may be formed, in order to prevent a flow of the developer toward the side or end face of the photosensitive member, thus preventing a marring of the image and contamination or failure of the machine. However, since the troughs are formed around the periphery of the photosensitive member 1 which rotates on a shaft 3, it will be seen that the troughs 2 also rotate, causing a scattering of the liquid contained in the troughs 2 under the influence of centrifugal force. Where a cleaning liquid is used, the liquid flow toward the side of the photosensitive member will be particularly increased at the position of the cleaning blade, so that a flange 4 which defines one side of the trough 2 must have an increased size. However, the presence of adjacent members makes it difficult to permit an increase in the size of the flange 4. As a consequence, this approach leaves much to be desired in preventing the liquid flow.

Another apparatus is shown in FIG. 2 in which a stationary member 14 having a groove 12 formed therein is located close to the respective opposite ends of a photosensitive member 11. While the photosensitive member 11 rotates on a shaft 13, the stationary members do not rotate, so that a scattering of the liquid contained in the groove 12 is avoided. However, there remains the second inconvenience mentioned above in connection with the apparatus shown in FIG. 1. Specifically, because the photosensitive member 11 rotates while the member 14 remains stationary, it is difficult to locate both of the members in exact conformity all around the periphery, particularly when the photosensitive member is in the form of a drum or an endless belt. Thus, a spillage or dripping of the liquid may result.

SUMMARY OF THE INVENTION

Therefore, it is an object of the invention to provide an apparatus for preventing an unintended liquid flow within a copying machine which avoids the above-mentioned disadvantages of the prior art, namely, a scattering or spillage of the liquid, without requiring a high precision in the relative position of various members.

DETAILED DESCRIPTION OF THE PREFERRED EMBODIMENT OF THE INVENTION

Figure 1:
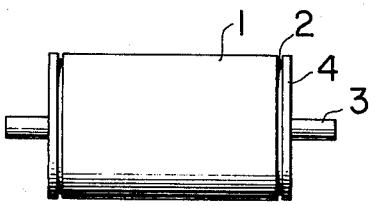
FIG. 1 Prior Art
FIG. 1 is a front view of a conventional photosensitive member.
Figure 2:
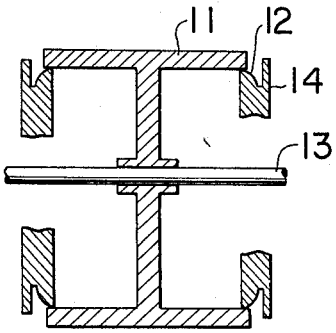
FIG. 2 Prior Art
FIG. 2 is a cross section of another conventional photosensitive member.
Figure 4:
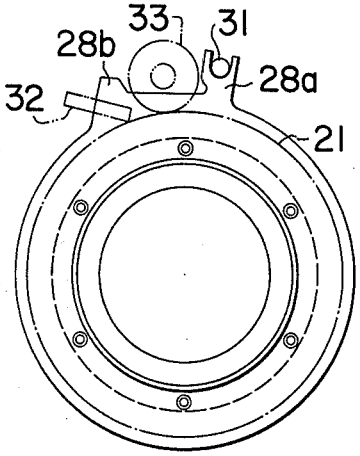
FIG. 4 is a front view of the combination of a flow guide member and a support therefor which are used in the present invention.
Figure 3:
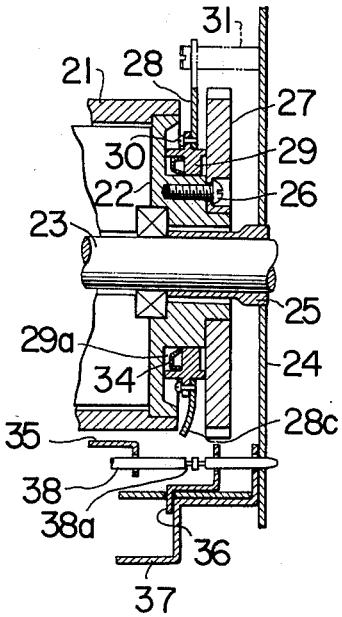
FIG. 3 is a fragmentary section of one embodiment of the invention.

FIG. 3 is a fragmentary section of one embodiment of the invention, illustrating one end of a photosensitive member 21. The member 21 is drum-shaped and has a bearing member 22 secured to each of its ends. The bearing member 22 supports a shaft 23 which is in turn supported within the copying machine by a fitting engagement with a bearing 25 which is secured to a sideplate 24. The sideplate 24 is mounted on the copying machine and is locked against rotation. A drive gear 27 is secured to the outer side of the bearing member 22 as by screw 26, and an external power is transmitted to the photosensitive member 21 through the gear 27 and the bearing member 22. Intermediate the bearing member 22 and the drive gear 27, a flow guide member 28 is secured as by screw 30, to a support 29 which is rotatably mounted on the bearing member 22. The flow guide member 28 has the same outer diameter as the drive gear 27, and is formed with a pair of projections 28*a* and 28*b* extending outwardly from part of its periphery, as shown in FIG. 4. The projection 28*a* extends in a given direction and its free end is bifurcated to receive a stud 31 which is mounted on the sideplate 24. As a consequence, the flow guide member 28 is locked against rotation even though it is secured to the support 29 which is rotatably mounted. The other projection 28*b* extends in a direction relative to the projection 28*a* which is determined in accordance with the position of a cleaning blade 32 which remains stationary. A cleaning roller is shown at 33. As indicated in FIG. 3, the flow guide member 28 includes a portion 28*c* which is located adjacent to a developing electrode plate 35 and which is slightly curved toward the latter. In the region of engagement with the bearing member 22, the support 29 is formed with a hollow region 29*a* in which a sealing element 34 is inserted.

A holding member 36 supports the developing electrode plate 35 in conformity to the peripheral surface of the photosensitive member 21, and the holding member 36 as well as a liquid reservoir 37 which stores a developing solution or a liquid to be collected are both supported by the sideplate 24 by means of a stud 38. Toward the holding member 36, the stud 38 is formed with a groove 38*a* which prevents a flow of the liquid along the stud 38 toward the sideplate 24. The holding member 36 and the reservoir 37 are formed with an elongate slot for fitting engagement with the stud 38 so that they can be lowered when dismounting the photosensitive member 21, thus preventing a damage to the latter which may be caused by abutment of the edges of these members against the photosensitive member.

The motive power is transmitted through the drive gear 27 to rotate the photosensitive member 21 through the charging, exposure and developing steps. In the developing station, a developing solution is supplied from the reservoir 37 into the space between the developing electrode plate 35 and the photosensitive member 21, and flows therein axially of the photosensitive member. Part of the liquid falls down from the end of the developing electrode plate 35. However, the continued rotation of the photosensitive member 21 tends to impart a kinetic energy to the liquid, which therefore attempts to flow axially beyond the edge of the plate 35. The provision of the stationary flow guide member 28 having the same diameter as the gear 27 and having the portion 28*c* which is curved toward the developing electrode plate 35 effectively blocks the energized flow, preventing the gear 27 from being wetted by the liquid, and also guiding it into the reservoir 37. The flow of the dripping liquid along the stud 38 toward the sideplate 24 is prevented by the groove 38*a* formed therein.

When the portion of the photosensitive member 21 on which the latent image is formed and developed has passed through the transfer station and reaches the cleaning station, a cleaning liquid is supplied to the surface thereof from the cleaning roller 33 and/or between the cleaning roller 33 and the cleaning blade 32. The liquid supplied is dammed up by the cleaning blade 32, and vigorously flows axially of the photosensitive member. The energy of this flow depends on the resistance presented by the cleaning blade 32 and the rate of rotation of the photosensitive member 21, but the energy of flow is greater than that of the axial liquid flow which occurs in the developing station, thus requiring a flow blocking plate of an increased size to prevent the contamination of adjacently located members. In the present invention, the projection 28*b* of the flow guide member is located at the position of the cleaning blade 32 to effectively prevent such axial flow the liquid.

The liquid supplied to the photosensitive member at the cleaning station is prevented from flowing axially by the flow guide member 28 and is guided therealong into the reservoir 37. Some of this liquid may tend to find its way toward the gear 27 through the clearance between the engaging support 29 and bearing member 22, but such an eggress is prevented by the sealing element 34. It should be understood that any one of a variety of sealing elements may be used at this end, and a sponge material may be disposed to insure against a degradation in the sealing function which may result from drying up.

The configuration of the flow guide member is not critical, but has a degree of freedom in that a suitable projection may be formed where the axial liquid flow is increased or that the guide member may be configured to facilitate the guiding action for the liquid or to control the position to which the liquid is to be guided. Since an eggress through the guide member is prevented by the sealing element in addition to blocking the axial liquid flow from the periphery of the photosensitive member, the eggress of the liquid is entirely achieved all over the side of the photosensitive member, thus fully accomplishing the initial-mentioned objectives of preventing a contamination and failure of the apparatus and a marring of the image.

What is claimed is:

1. A construction for preventing a scattering of liquid applied to the peripheral surface of a rotating photosensitive member beyond the lateral ends thereof in an electrophotographic copying machine of the wet developing type comprising:

a. end plate means liquid-tightly secured to an end of said photosensitive member and having a boss extending outwardly and concentrically with the axis of rotation of said member, b. support means rotatably mounted on said boss, c. means for liquid-tightly sealing between said boss and said support means, d. a flow guide member secured to said support means and spaced apart from the end surface of said photosensitive member for guiding liquid from the peripheral surface of said photosensitive member to flow down therealong.

e. means for preventing said guide member from rotating with said photosensitive member to thereby maintain said guide member stationary, and f. reservoir means disposed beneath said guide member for receiving liquid flowing down along said guide member.

2. A construction according to claim 1 wherein a cleaning station is provided at a position along the peripheral surface of said photosensitive member where liquid is scraped therefrom and said guide member comprises a projection extending radially at a position in conformity with said station.

3. A construction according to claim 1 wherein said guide member is curved inwardly at least at its lowest portion.

4. A construction according to claim 1 wherein said sealing means comprises a sealing ring.

5. A construction according to claim 4 wherein said sealing means further comprises means for maintaining said ring to be wetted with liquid used.

6. A construction according to claim 5 wherein said maintaining means comprises a sponge-like material.

7. A construction according to claim 1 wherein said reservoir means is accommodated to store a developing solution which is supplied to the peripheral surface of said photosensitive member for developing an electrostatic latent image thereon.

8. A construction according to claim 7 wherein a cleaning station is provided where the peripheral surface of said photosensitive member is cleaned by use of the developing solution supplied from said reservoir means.

9. A photosensitive drum construction for an electrophotographic copying machine, comprising support means, a photosensitive drum having a bearing plate end with an axially extending hub portion, a flow guide ring sealingly engaged on said hub portions around the periphery thereof and preventing axial migration of liquid from said drum past said guide ring but permitting liquid to fall downwardly along said guide ring off the periphery thereof, and means to hold said flow guide ring against rotation, said photosensitive drum and said bearing plate end with said hub portion being rotatable.

10. A photosensitive drum according to claim 9, including means connected to said hub portion to rotate said drum.

11. A photosensitive drum according to claim 10, wherein said means to rotate said drum comprises a gear affixed to said hub portion and adapted to be driven.

12. A photosensitive drum according to claim 9, wherein said support means comprises a stationary side plate, a journal member carried in said side plate, a drum shaft supported in said journal member, bearing means on said journal member rotatably supporting said hub portion of said bearing plate end.

13. A photosensitive drum according to claim 12, wherein said guide ring has a lower portion curved inwardly toward said drum for deflecting liquid in a direction toward said drum.

14. A photosensitive drum construction according to claim 13, including a stud connected to said side plate, an electrode plate carried by said stud and located in spaced relationship to the periphery of said drum, said stud having an interrupted groove part so as to prevent the transmission of fluid therealong, said guide ring having a seal member disposed between it and said end plate deflecting liquid in a direction toward said end plate.

* * * * *